US007645055B2

(12) United States Patent
Neeld et al.

(10) Patent No.: US 7,645,055 B2
(45) Date of Patent: Jan. 12, 2010

(54) LUMINAIRE OPTICAL ASSEMBLY

(75) Inventors: James N. Neeld, Tiverton, RI (US); Paul J. Shapiro, Riverside, RI (US); Margaret L. Hetfield, Bristol, RI (US); Richard Meyer, Providence, RI (US)

(73) Assignee: Genlyte Thomas Group, LLC, Burlington, MA (US)

( * ) Notice: Subject to any disclaimer, the term of this patent is extended or adjusted under 35 U.S.C. 154(b) by 0 days.

(21) Appl. No.: 11/680,299

(22) Filed: Feb. 28, 2007

(65) Prior Publication Data

US 2008/0205067 A1 Aug. 28, 2008

(51) Int. Cl.
*F21S 8/06* (2006.01)
*F21V 3/00* (2006.01)

(52) U.S. Cl. ..... 362/268; 362/311.13; 362/405

(58) Field of Classification Search ..... 362/147, 362/223, 224, 255, 256, 311, 317, 404, 405, 362/406, 433, 452, 312, 313, 314, 253, 268, 362/326, 330, 331, 363, 408, 457, 145, 217, 362/257, 368, 184, 185, 169, 171, 173, 806, 362/810

See application file for complete search history.

(56) References Cited

U.S. PATENT DOCUMENTS

| | | | | | |
|---|---|---|---|---|---|
| 966,162 | A | * | 8/1910 | Brown | 362/376 |
| 1,032,660 | A | * | 7/1912 | Czemy | 362/382 |
| 1,584,555 | A | | 5/1926 | Kleine | |
| 1,700,538 | A | | 1/1929 | Grant et al. | |
| 1,752,654 | A | * | 4/1930 | Rosenblatt | 362/317 |
| 2,131,054 | A | | 9/1938 | Kurth | |
| 2,246,320 | A | * | 6/1941 | Rolph | 362/309 |
| 2,980,285 | A | | 4/1961 | Parsons | |
| 3,001,001 | A | | 9/1961 | Bibb | |
| 3,047,829 | A | | 7/1962 | Mouat | |
| 3,437,059 | A | | 4/1969 | Stonier et al. | |
| 3,485,519 | A | | 12/1969 | Chak-Fai Chiu | |
| 3,517,849 | A | | 6/1970 | Presnick | |
| 3,528,692 | A | | 9/1970 | Vries | |
| 3,579,939 | A | | 5/1971 | Eichman | |
| 3,590,135 | A | | 6/1971 | Herbenar et al. | |
| 3,606,419 | A | | 9/1971 | Virkler et al. | |
| 3,626,424 | A | | 12/1971 | Kahm | |
| 3,645,569 | A | | 2/1972 | Reilly | |
| 3,684,883 | A | | 8/1972 | Entwistle | |
| 3,726,551 | A | | 4/1973 | Levenberg | |
| 3,736,035 | A | | 5/1973 | Brown et al. | |
| 3,736,717 | A | | 6/1973 | Farley | |
| 3,878,505 | A | | 4/1975 | Seibert | |
| 3,894,505 | A | | 7/1975 | Murphy | |
| 3,955,702 | A | | 5/1976 | Lundy | |

(Continued)

*Primary Examiner*—Ismael Negron
*Assistant Examiner*—David R Crowe
(74) *Attorney, Agent, or Firm*—Middleton Reutlinger; John F. Salazar

(57) ABSTRACT

A luminaire assembly includes a housing having a first end and a second end, one of the first end and the second end having a threaded connection, a glass lens and a collar assembly connected to said lens, the collar assembly threadably connected to the housing. A luminaire lens mounting assembly, further may include a first lens connected to a housing, a belt connected to the housing, at least one arm extending from the belt, and, a second lens surrounding at least one of the housing and the first lens, the at least one arm extending through the second lens.

18 Claims, 14 Drawing Sheets

U.S. PATENT DOCUMENTS 3,985,417 A 10/1976 Fenton
4,003,618 A 1/1977 Booty
4,029,953 A 6/1977 Natoli
4,104,713 A 8/1978 Chan et al.
4,114,327 A 9/1978 Williams
4,126,810 A 11/1978 Cox
4,227,424 A 10/1980 Schleappe
4,280,170 A 7/1981 Baldwin
4,352,327 A 10/1982 Sleep
4,361,992 A 12/1982 Rapp
4,363,086 A 12/1982 Fletcher
4,410,932 A * 10/1983 Oster ..... 362/294
4,426,677 A 1/1984 Dennis
4,428,032 A 1/1984 Workman
4,431,254 A 2/1984 Cartesse
4,504,888 A 3/1985 Rosenthal
4,531,179 A 7/1985 Baker
4,539,631 A * 9/1985 Lieberman ..... 362/351
4,595,971 A 6/1986 Dean
D286,445 S * 10/1986 Sink ..... D26/86
4,670,822 A 6/1987 Baker
4,702,711 A 10/1987 Falchi
4,740,870 A * 4/1988 Moore et al. ..... 362/477
4,758,181 A 7/1988 Reedy
4,763,231 A 8/1988 Houplain
4,816,977 A 3/1989 Sorensen
4,858,089 A 8/1989 Pietro
5,029,783 A 7/1991 Alvarez
5,067,906 A 11/1991 Woodgate
5,134,554 A 7/1992 Donato et al.
5,149,282 A 9/1992 Donato et al.
5,273,452 A 12/1993 Donato et al.
6,079,992 A 6/2000 Kuchar et al.
D429,360 S * 8/2000 Chelf et al. ..... D26/86
6,237,446 B1 5/2001 Zhang
6,676,281 B2 * 1/2004 Bray et al. ..... 362/391
6,746,138 B1 6/2004 Gamache et al.
6,866,396 B2 3/2005 Ward
7,111,957 B2 9/2006 Bernhart et al.
D563,590 S * 3/2008 Hetfield et al. ..... D26/88

* cited by examiner

LUMINAIRE OPTICAL ASSEMBLY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates to a luminaire and more particularly an assembly for connection of a lens to a luminaire housing for various lighting environments.

2. Description of the Related Art

Luminaires are designed to produce a predetermined light pattern on an area to be illuminated. Typical luminaires include ballast housing for positioning of the electrical hardware for driving the luminaire and an optical assembly mounted to the ballast housing. The optical assembly may include a refractor or reflector, generally referred to hereinafter as a lens, disposed about a light source.

Prior art lenses may have a threaded neck which is threadably connected to the ballast housing providing the connection between the ballast housing and a lens. However, forming a thread feature on a lens typically weakens the glass lens such that the weight of the lens may be supported by a weakened area which ultimately may result in the lens breaking. Further, it is also desirable to have a clean connection between the ballast housing and lens, which does not draw the eye of a bi-standard within the area being illuminated.

According to some embodiments, it may be desirable to utilize a second outer reflector extending about the inner lens connected to the housing. However, it is also preferable to utilize the same housing design for either the single lens or double lens design, which simplifies manufacturing.

Given the foregoing, it will be appreciated that a lens mounting assembly is desired which allows for clean connection of an inner lens to a housing, as well as connection of an outer lens about the inner lens and housing.

SUMMARY OF THE INVENTION

A luminaire lens mounting assembly, comprising a first lens connected to a housing, a belt connected to the housing, at least one arm extending from the belt, and, a second lens surrounding at least one of the housing and the first lens, the at least one arm extending through the second lens. The luminaire assembly housing has a first portion and a second portion. The luminaire assembly belt disposed between the first portion and the second portion. The luminaire assembly wherein the first portion is connected to the second portion by threaded fasteners.

A luminaire lens mounting assembly comprises a first lens connected to a housing, a plurality of arms extending from the housing, the arms extending through a second lens. The luminaire lens mounting assembly further comprises a belt connected to the housing. The luminaire lens mounting assembly further comprises a clip connected to the belt wherein the plurality of arms are connected to the clip. The luminaire lens mounting assembly second lens surrounds the first lens. The luminaire lens mounting assembly second lens surrounds at least a part of said housing. The arms are equidistantly spaced. The luminaire lens mounting assembly further comprises a sleeve disposed between the second lens and the arms.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
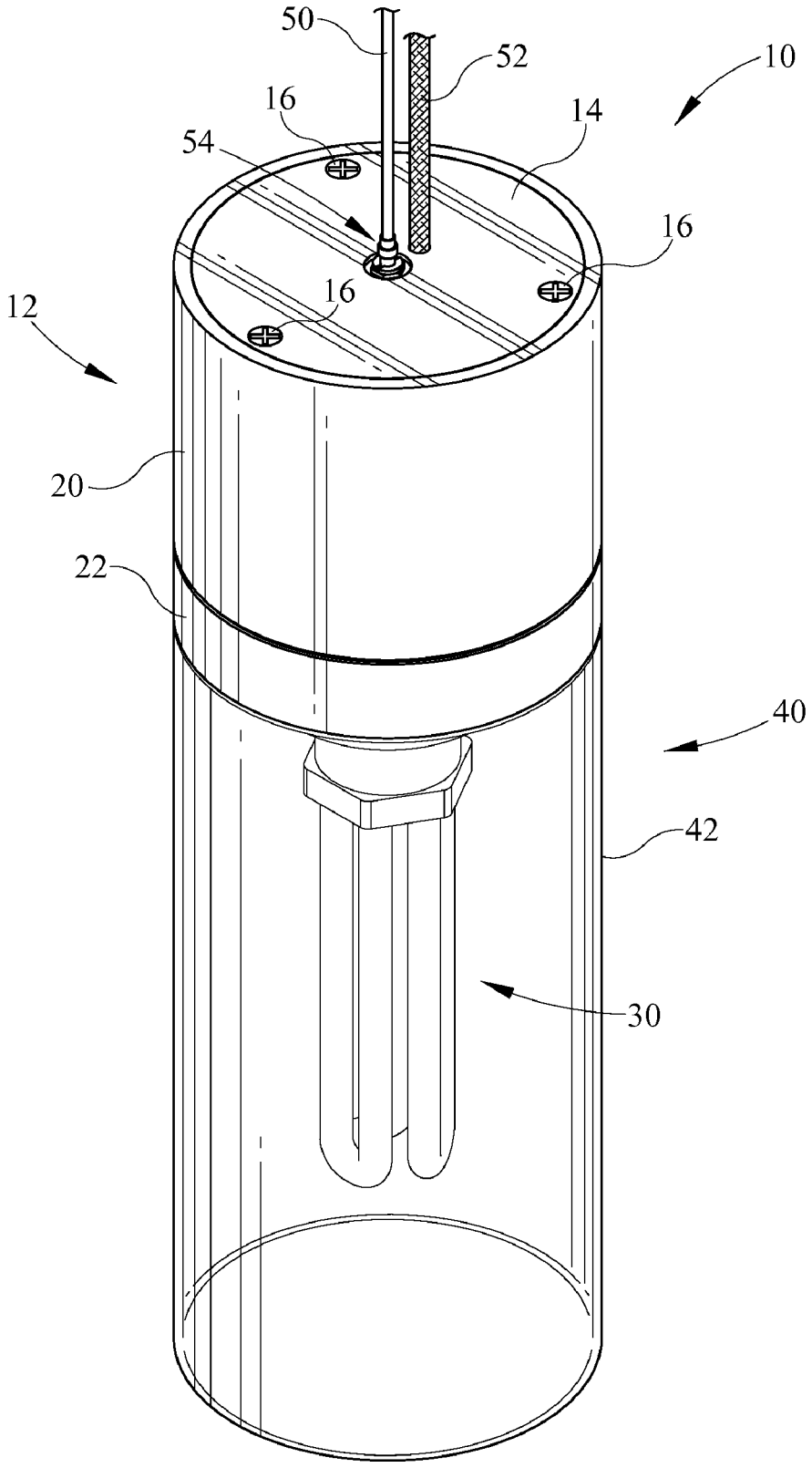
FIG. 1 depicts a perspective view of a luminaire.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 14:
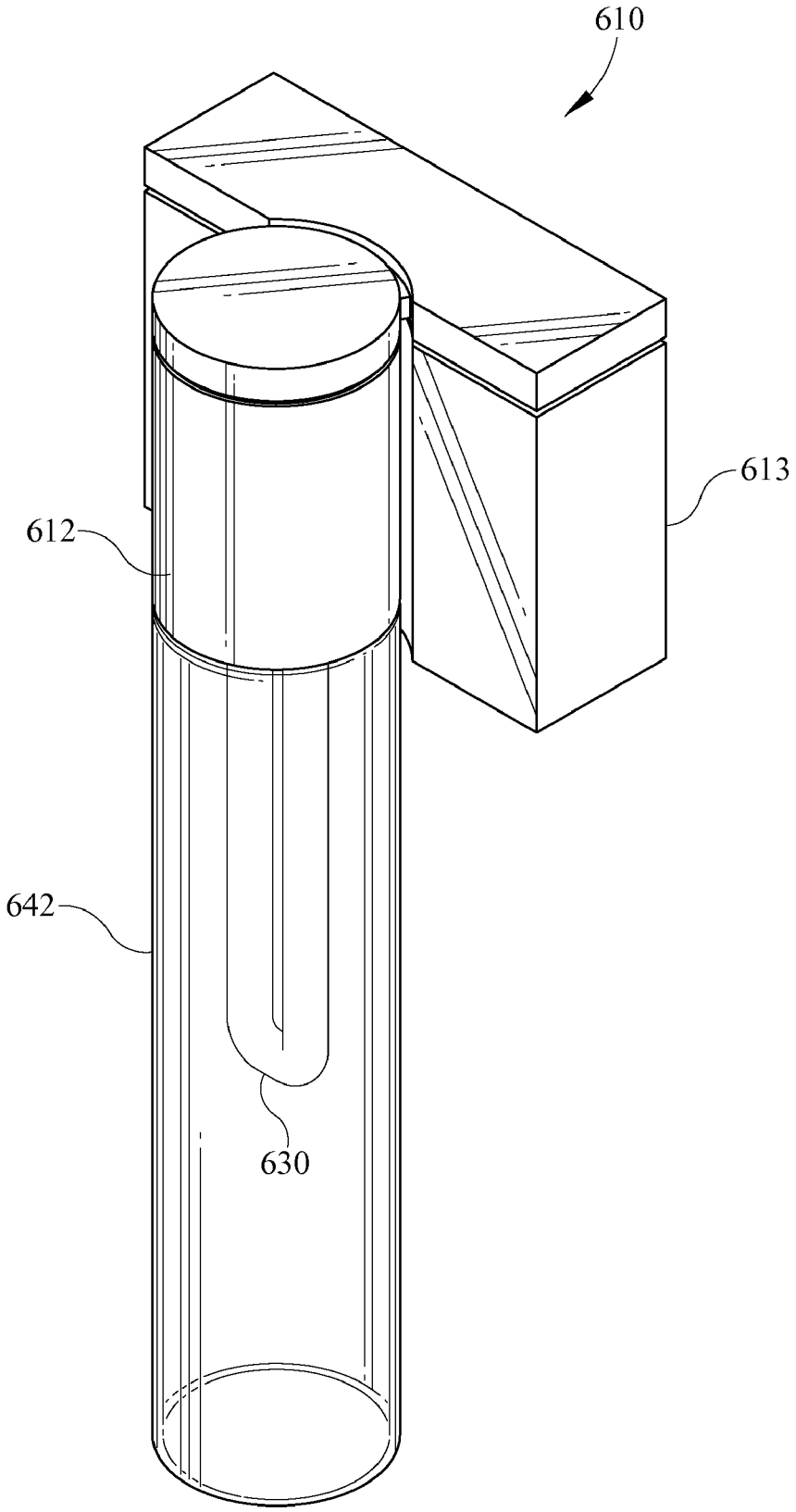

With reference initially to FIG. 1, a luminaire 10 is depicted in perspective view. The luminaire 10 distributes light to areas needing illumination, for instance a bar area or other such environment typically illuminated by the exemplary pendant luminaire. Although various pendant luminaires will be shown and described herein, the assembly features described herein may be utilized with other types of lighting hardware as will be understood by one skilled in the art. For example, instead of a pendant luminaires an alternative sconce assembly is shown in FIG. 14, but such construction should not be considered limiting.

The luminaire 10 comprises a housing 12 which is substantially cylindrical but is not limited to such shape. The ballast housing 12 has an upper cover portion 14 which is fastened by a plurality of screws 16 to the housing 12. Although Phillips head screws 16 are depicted, one skilled in the art should realize that alternative fasteners may be utilized such that the connection between the cover 14 and housing 12 is not limited to a screw fastener.

The housing 12 comprises an upper portion 20 and a lower portion 22. Inside the upper portion 20 are fastening bosses (not shown) which receive the fasteners 16 so that the top cover 14 may be fastened to the upper portion 20 of housing 12. The upper portion 20 is generally hollow and receives electrical hardware for driving a lamp 30. Such electrical hardware (not shown) may include a ballast transformer, capacitor and other electrical hardware typically associated with luminaires as known by those skilled in the art and, therefore, not depicted. Further, additional equipment may be disposed within the housing 12 such as a back-up power supply or battery pack may be disposed within the housing 12 or emergency back-up circuitry. The upper portion 20 also defines a junction box area for wiring connections between the power supply (not shown) and the electrical hardware therein. A socket plate (not shown) is positioned within the lower opening of the upper portion 20 and fastened to bosses located within the upper portion 20 opposite the top cover 14. A socket is connected to the socket plate for connection of lamp 30. The lower portion 22 is threadably connected to the upper portion 20 and against the socket plate. According to this construction, the socket is positioned co-axially within or adjacent to the lower portion 22. Alternatively, the lower portion 22 may also include a socket or socket plate as an integral element for connecting the lamp 30. Alternatively, As depicted, the lamp 30 is a bi-axial compact fluorescent lamp having three substantially U-shaped tubes. However various alternative lamps may be utilized including, but not limited to, incandescent, high intensity discharge (HID) such as, mercury vapor, metal halide (also HQI), high-pressure sodium, low-pressure sodium and less common, xenon short-arc lamps. Further, other CFLs may be utilized such as single tube or multiple tube CFLs or spiral type CFLs. As a further alternative, LEDs may also be utilized, but the preceding lamp types should not be considered limiting. Instead the lamps are merely exemplary types of sources.

Extending from the upper ceiling surface (not shown) through the top cover 14 are two cables. The first cable 50 is a pendant cable and supports the weight of the luminaire 10 depending from the upper ceiling structure or ceiling support structure, such as a ceiling or T-grid assembly. The pendant cable 50 may be formed of aircraft cable or other known support cables for pendant lights and extends through an adjustment mechanism 54. The adjustment mechanism 54 locks against cable 50 to set the height of the luminaire 10 some distance from a ceiling above. The second cable 52 is a conduit which provides power from a power source (not shown) remote from the luminaire 10 into the upper portion 20 which is connected by wiring connections therein to the ballast and capacitor to power the lamp 30. One skilled in the art should understand that the pendant cable 50 may be substituted for a more rigid structure such as a rod or stem assembly or the like from which the luminaire 10 may depend.

Figure 2:
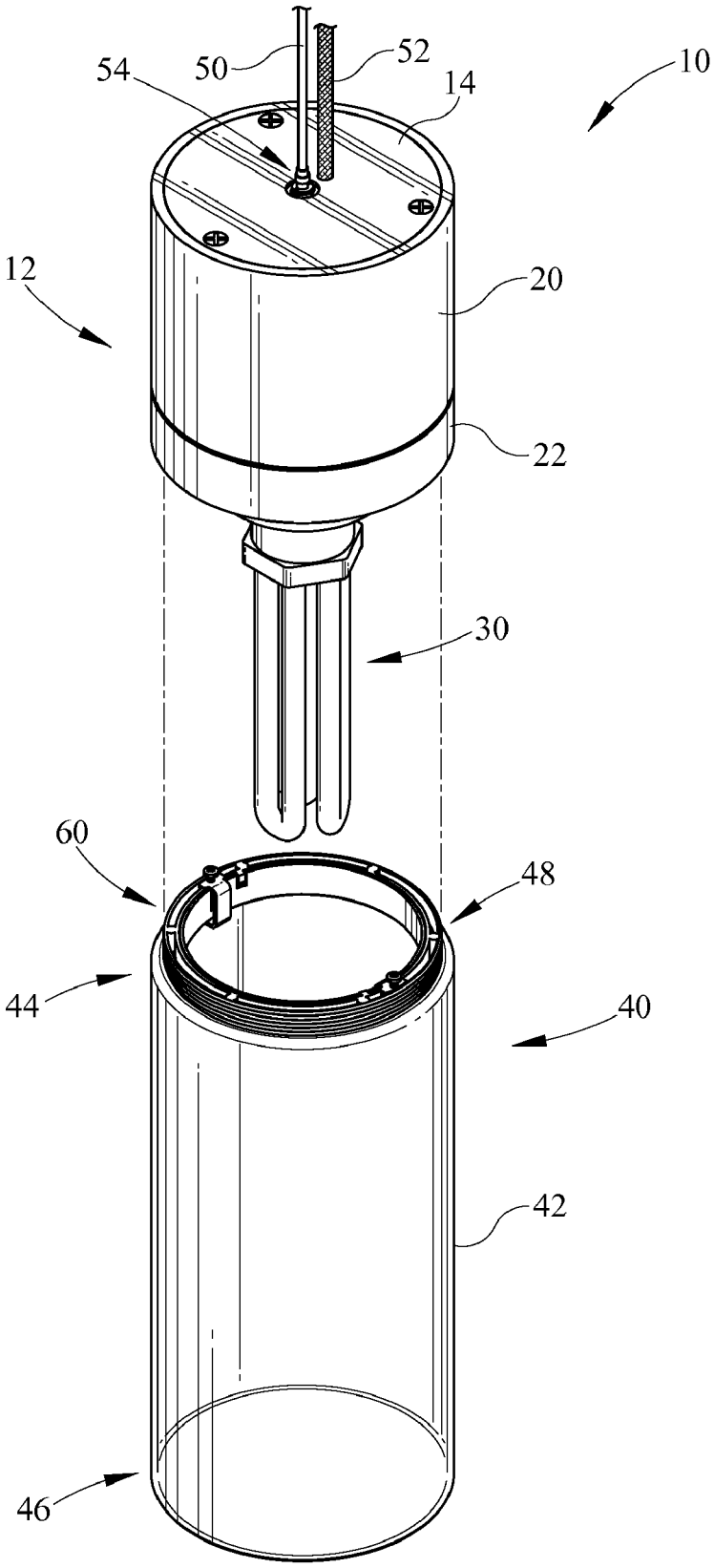
FIG. 2 depicts a perspective view of the housing separated from the lens.

Referring now to FIGS. 1 and 2, the luminaire 10 is depicted. In FIG. 2, an optical assembly 40 is depicted separated from the housing 12. The optical assembly 40 comprises a lens 42 which has a first end 44 and a second end 46. The lens 42 may be formed of hand blown triplex glass, clear glass, acrylic or other equivalent structures known to one skilled in the art. The lower second end 46 is defined by an opening. The lens 42 is depicted as being generally cylindrical in shape, however, various shapes can be utilized for the lens 42 as will be shown further herein. At the first, upper end 44 of the lens 42 is a neck 48. The neck 48 may be defined by an upstanding flange or may be a horizontally extending flange. The necks 48 depicted throughout this description are substantially horizontal but should not be limited to such construction as vertical necks may be accommodated as will be understood by one skilled in the art. Also, located at the upper end of the optical assembly 40 is a collar assembly 60 which allows for attachment of the optical assembly 40 to the housing 12. The collar assembly 60 is generally hidden from view by housing 12 such that a clean connection is made between the lens 42 and the housing 12. This renders a luminaire which is aesthetically pleasing.

Figure 3:
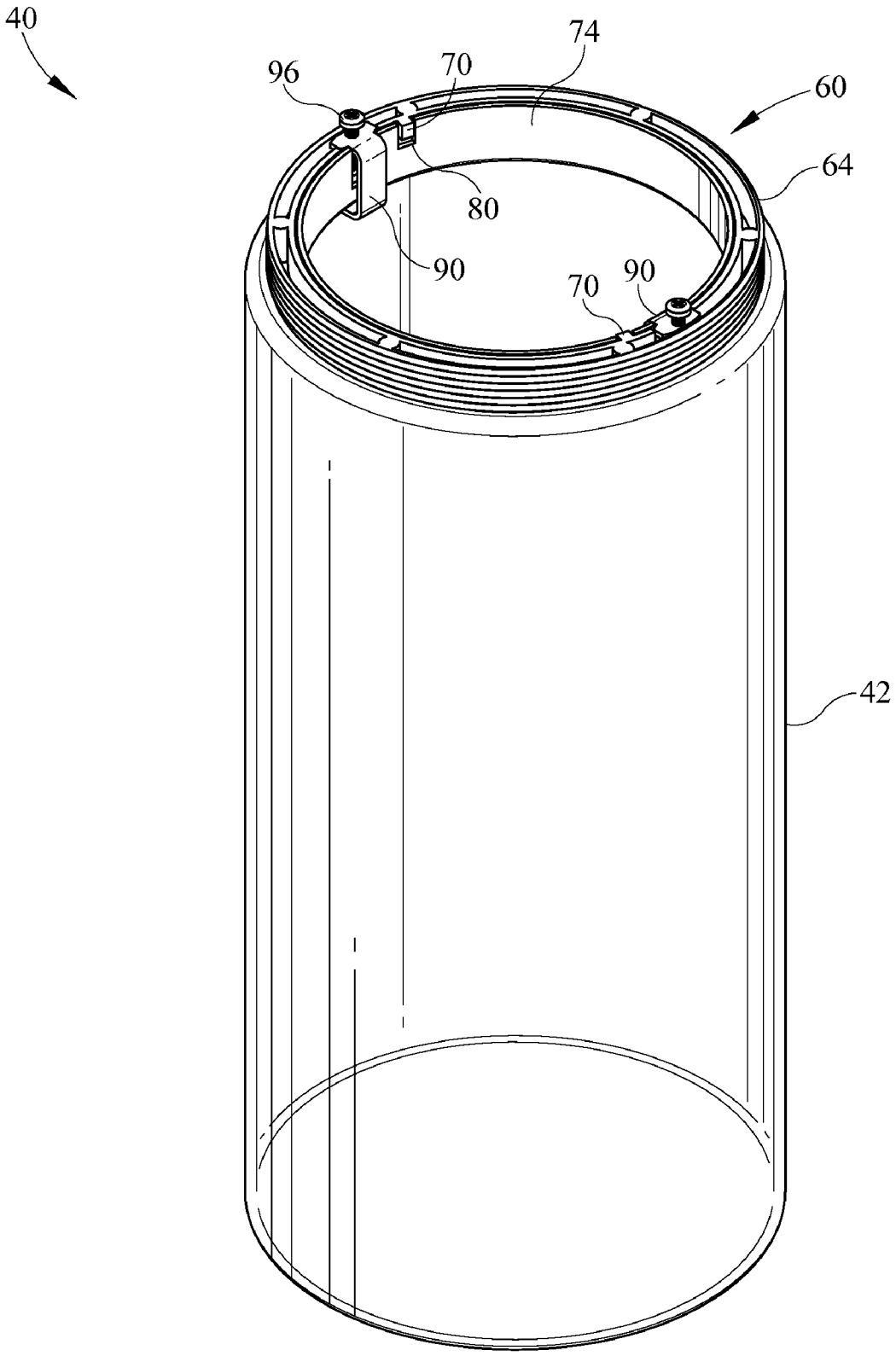
FIG. 3 depicts a perspective view of the lens and collar assembly.
Figure 4:
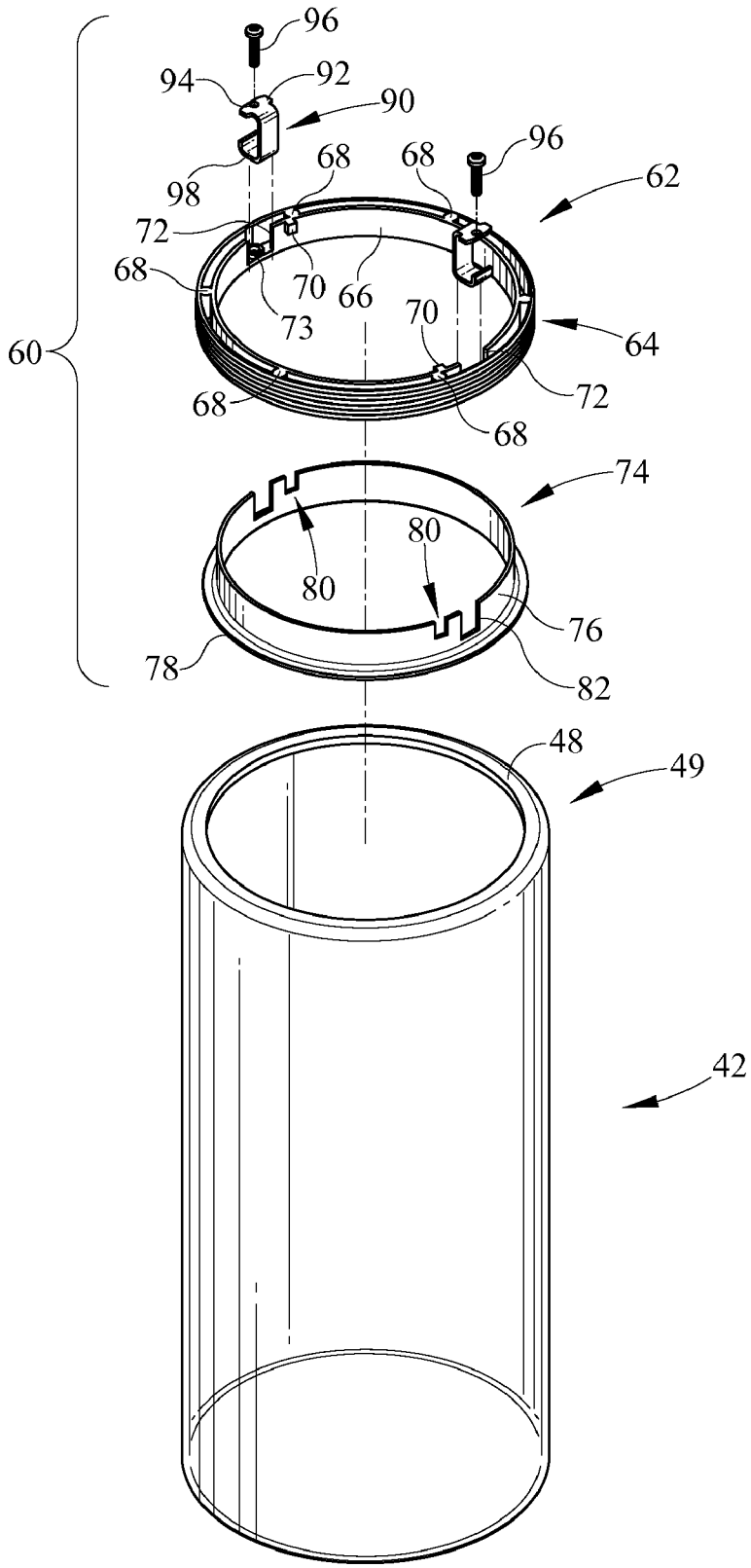
FIG. 4 depicts an exploded perspective view of the optical assembly.

Referring now to FIGS. 3 and 4, the optical assembly 40 is depicted in a perspective view and in an exploded perspective view, respectively. The collar assembly 60 includes a threaded collar 62 having a generally cylindrical shape and a second, inner collar or neck ring 74. The exemplary threaded collar 62 is defined by a threaded ring or band 64 and an inner ring or band 66. The outer ring 64 and inner ring 66 are separated by a plurality of stiffeners 68. This construction should not be considered limiting as the threaded collar 62 may be formed of a single ring or multiple rings. The diameter of the threaded collar 62 is substantially equivalent to the inner diameter of the lower portion 22 of housing 12 so that the optical assembly 40 can be fastenably received within the housing 12. The inner ring or band 66 includes at least one radially extending key 70 which may vary in shape. The inner band 66 also comprises a clamp notch 72 described further herein.

The collar assembly 60 also comprises a second, inner collar or neck ring 74 including a generally upstanding inner collar wall 76 and flange 78 positioned at a lower end of the collar wall 76. The inner collar 74 is positioned co-axially with the collar 62 and extends therethrough. Once assembled, the collar assembly 60 is positioned at the first end 44 of the lens 42 with the flange 78 positioned against the lower surface of neck 48 and the threaded collar positioned on the upper surface of neck 48. The collar wall 76 further comprises a keyway 80 which corresponds in shape to the key 70 of the threaded collar 62. The keyway 80 is positioned at locations of the inner collar wall 76 corresponding to the locations of the key 70 of threaded collar 62. As indicated previously, the keyway 80 may vary in shape depending on the various shapes which may be utilized for the key 70 of the collar 62. Likewise, the collar wall 76 comprises a clamp notch 82 which aligns with the notch 72 when the key 70 and keyway 80 are aligned.

The collar assembly 60 also comprises at least one clamp 90 which retains the collar assembly 60 to the lens 42 defining the optical assembly 40. The clamps 90 are substantially C-shaped with an upper leg 92 having an aperture 94 therein for receiving a fastener 96. The aperture 94 is sized to threadably receive the fastener 96 so as to move with rotation of the fastener 96. A lower leg 98 engages the lower surface of the flange 78 to force the collar assembly 60 against the lens 42 by tightening of the fastener 96.

The inner collar 74 is positioned within the lens 42 from the lower opening upward against the neck or horizontal flange 48 so that the lower flange 78 abuts the neck 48 and the inner collar wall 76 extends upwardly through the upper opening at the first end 44 of lens 42 with the inner collar 74 extending upwardly from the upper end 44 of lens 42, the threaded collar 62 is positioned over the upwardly extending wall 76. The at least one key 70 is aligned with the at least one keyway 80 and the clamp notches 72, 82 are also aligned. Next, the clamps 90 are positioned against the collars 62, 74. Specifically, the upper leg 92 is formed having a width which is wider than the opening formed by the clamp notches 72, 82 and sized to fit between the inner ring 66 and threaded ring 64. The upper leg 92 is pushed downwardly against the lowermost surface of the collar 62 between the rings 64, 66 so that the lower leg 98 may be positioned against the lower surface of flange 78. Once the clamp 90 is positioned, a fastener 96 is inserted through the aperture 94 so as to bear against the collar material between the rings 64, 66. Further, a boss 73 may be positioned between the rings 64, 66 so as to receive the fastener 96 and maintain a vertical positioning of the fastener so that the clamp 90 does not disengage from the assembly allowing the lens 42 to fall. In addition to the clamp 90 or as an alternative, the collar assembly 60 may be affixed to the lens 42 by a fixative material such as cement, epoxy or the like.

Figure 5:
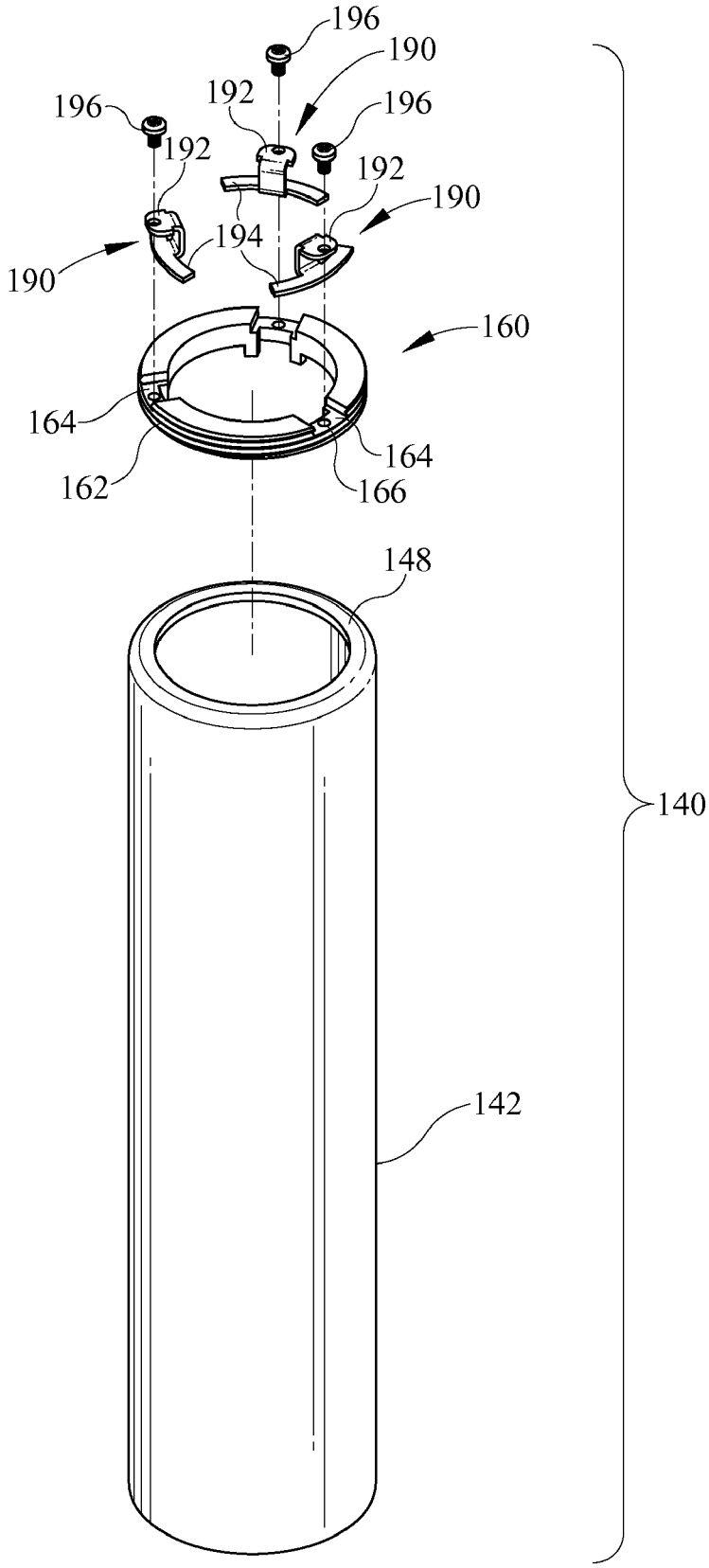
FIG. 5 depicts a perspective view of an alternative embodiment of the collar assembly.

Referring now to FIG. 5, an alternative clamping arrangement is depicted in an exploded perspective view. An optical assembly 140 is shown having a collar assembly 160 and a lens 142. As compared to the previously described embodiment, the lens 142 is also cylindrical in shape but is longer in an axial dimension and has a smaller diameter. Such construction should not be construed as limiting but merely exemplary.

The collar assembly 160 is generally circular in shape and includes an axial thickness such that an outer threaded surface 162 is defined between upper and lower surfaces of the assembly 160. Positioned about the circumference of the collar assembly 160 are clamp notches 164 which are cut out portions of the assembly which allow positioning of a clamp 190 therein. Each of the clamp notches 164 further comprises an aperture 166 wherein a fastener 196 may be received to attach the clamp 190 therein. Tightening rotation of the fastener 196 causes upward movement of the clamps 190 so that the lower leg 194 engages the lens 142 with increasing force as the fastener increases force on the threaded collar 160.

As previously described, the lens 142 is generally cylindrical in shape and has an upper flange or neck 148 upon which the collar assembly is seated. The collar assembly 160 is attached to the neck 148 of the lens 142 by the clamp 190. The clamp 190 includes an upper leg 142 which is sized to fit within the clamp notch 164 and further comprises a lower leg 194. The lower leg 194 is longer than the upper leg 192 to engage a surface area of the lower surface of neck 148. The lower leg 194 bears against a lower surface or edge of the neck 148 to retain the collar 160 on the neck 148. The upper leg 192 further comprises an aperture 166 through which a fastener 196 extends and bears against the collar assembly 160. The fastener 196 may be received within an aperture 166 to maintain a perpendicular down force on the upper leg 192 thereby inhibiting unintentional removal of the clamp 190 from the collar assembly 160. As the fastener 196 is tightened, the lower leg 194 is pulled up against the lower surface or edge of neck 148.

Figure 6:
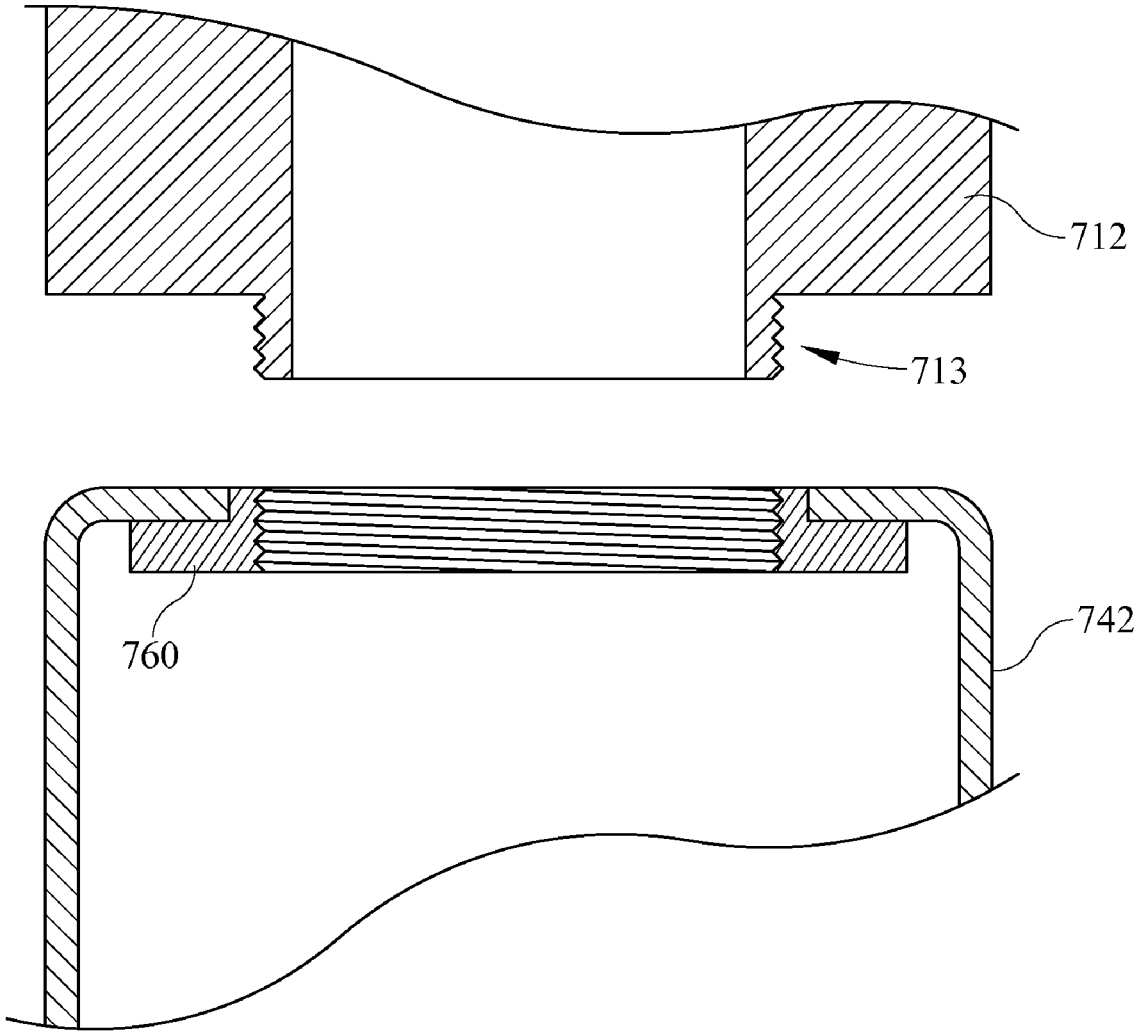
FIG. 6 depicts a further alternative embodiment of a collar assembly.

Referring now to an alternative embodiment shown in FIG. 6, a collar assembly 760 may be positioned along the inside surface of the neck of lens 742. In this configuration, the threads of the collar must be disposed along the inner surface of the collar 760 so that the threads can be engaged by a male member 713 extending through the upper neck of the lens 742 and engaging the inner threaded surface 262 of the collar 260. The collar assembly 760 may be fastened to the lens 742 with fasteners or may be affixed using a fixative material such as epoxy, glue, cement or other known fixatives.

Figure 7:
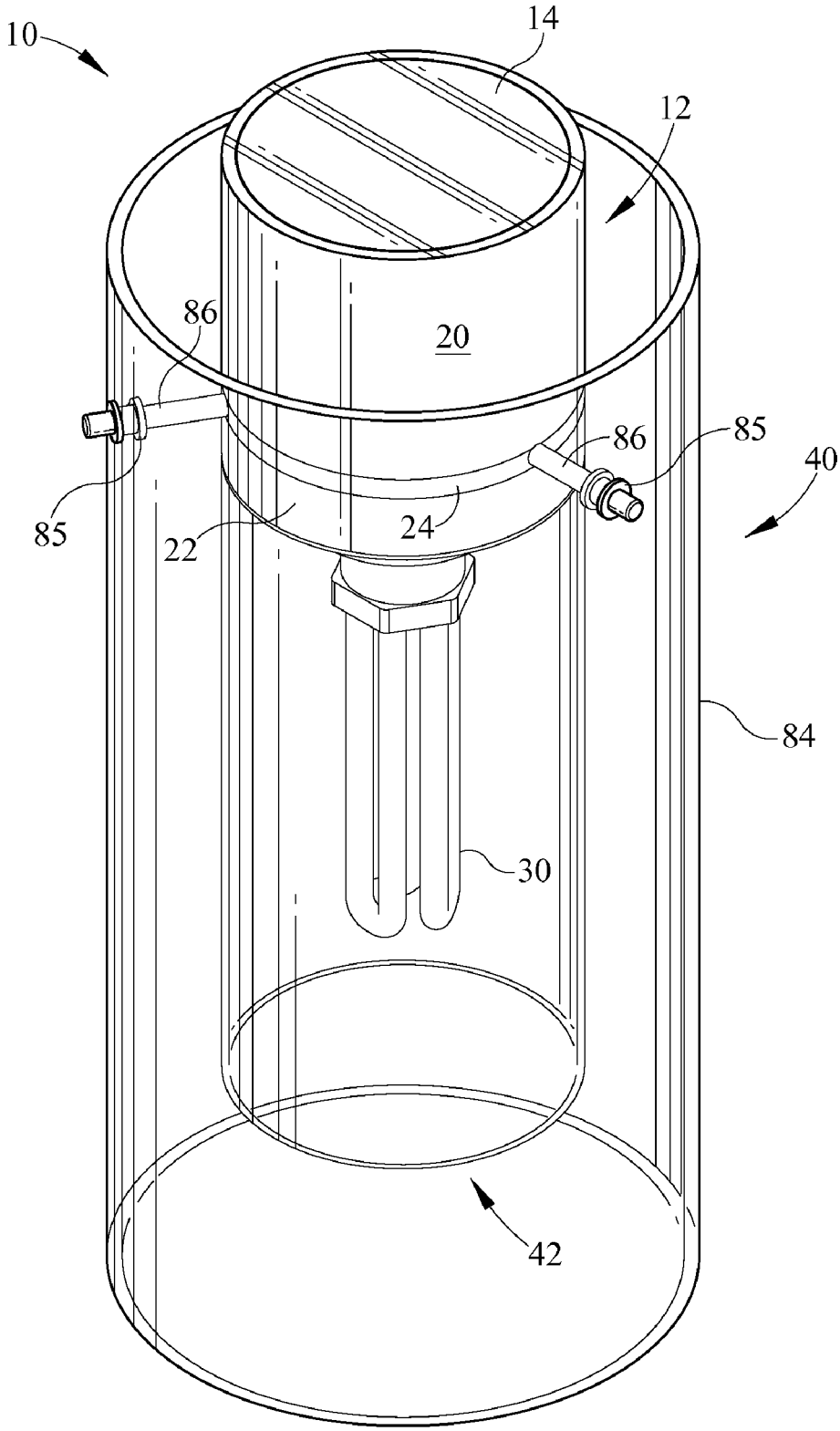
FIG. 7 depicts a perspective view of a luminaire having a secondary lens structure.

Referring now to FIG. 7, a second feature of the instant luminaire 10 is depicted. The luminaire 10 may comprise a second outer lens 84 disposed about the housing 12 and first, inner lens 42. The exemplary outer lens 84 may be formed of clear glass but such material should not be considered limiting. The outer lens 84 of the optical assembly 40 is connected to the luminaire 10 by additional structure described herein. As previously described, the luminaire 10 comprises a housing 12 formed of an upper portion 20 and a lower portion 22. The lower portion 22 comprises a socket (not shown) wherein a lamp 30 is attached. The upper portion 20 of the housing 12 includes a top 14 so that the attachment of the lower portion 22 to the upper portion 20 fully encloses the upper portion 20. The inner lens 42 is connected, as previously described, to the housing 20 so that the connection hardware is hidden within the housing 12.

Figure 8:
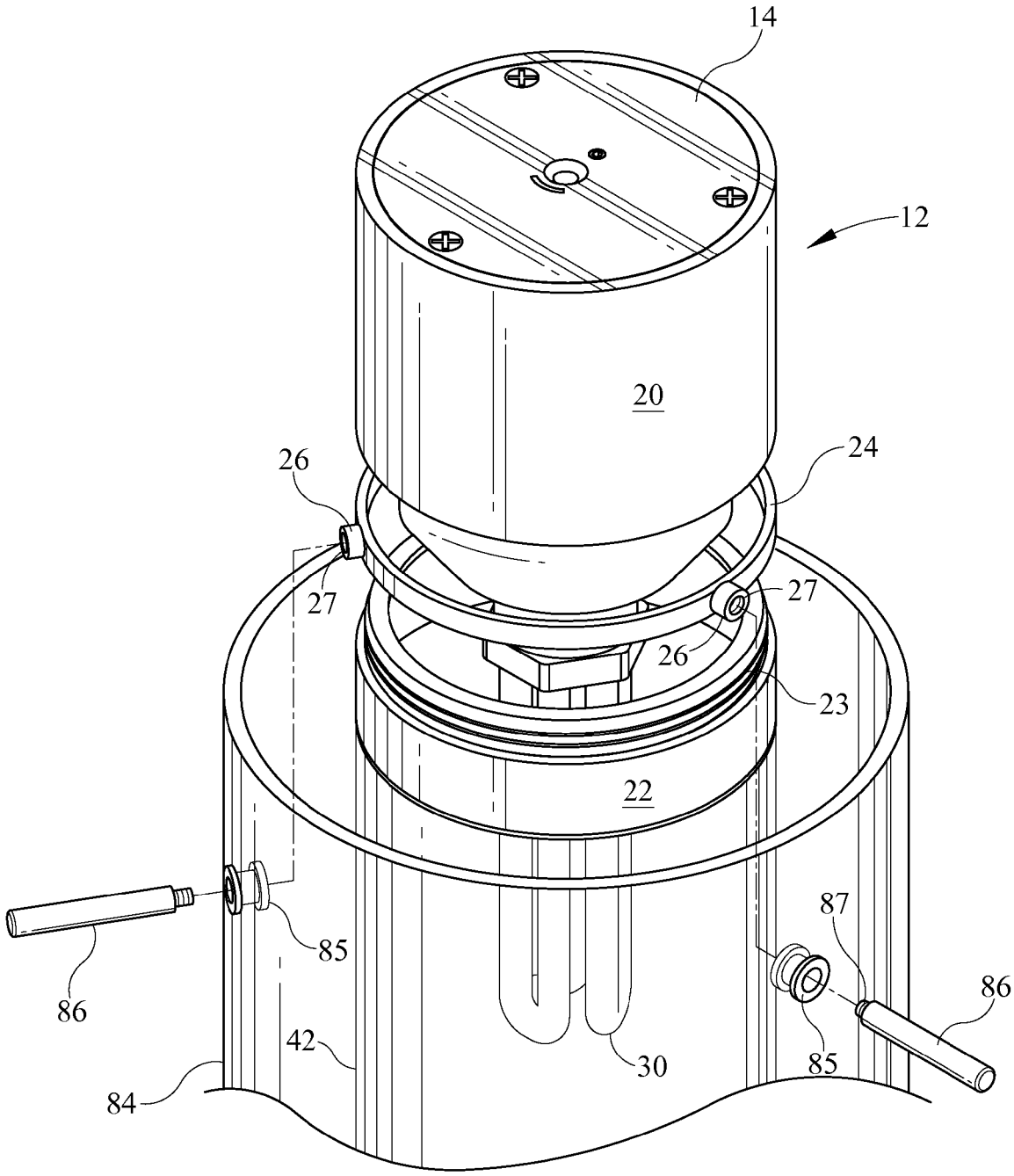
FIG. 8 depicts an exploded perspective view of the luminaire of FIG. 7 including an alternative belt structure.

Referring now to FIGS. 7 and 8, which includes an exploded perspective view of the luminaire 10, the housing 12 further comprises a belt 24 positioned between the first portion of the housing 20 and the second portion 22 of the housing 12. The belt 24 is substantially circular in shape having an axial thickness. The diameter of the belt 24 is sized to allow the belt 24 to slide over a threaded upwardly extending wall 23 of the lower portion 22. The threaded wall 23 has a diameter less than the inner diameter of the upper portion 20. The inside wall of the upper portion 20 is also threaded so as to mateably receive the threaded wall portion 23 of the lower housing 22. The wall 23 may be threaded or may have engagement tabs to mate with slots within the upper portion 20 so that the lower portion may be inserted upwardly and twisted to lock the lower portion 22 in position.

The belt 24 is sized to fit over the wall 23 and against a shoulder defined between the lower housing 22 which has a larger diameter and the threaded wall 23 extending upwardly therefrom. With the belt 24 disposed on the shoulder, the lower housing 22 is threadably connected to the upper housing 20 thereby capturing the belt 24 between the two elements 20, 22 of the housing 12. The construction should not be limited to that which is described herein. For example, a belt may be attached to the housing in a variety of ways other than by capturing between the upper and lower housing portions 20,22. For example, a belt may be formed integrally with the housing 12 or may be located near the top of the housing, as opposed to the embodiment shown herein.

The belt 24 further comprises collars 26 spaced about the periphery of the belt 24. The collars 26 comprise apertures 27 which threadably receive arms described further herein. The collars 26 should not be construed as limiting however, as the apertures 27 may be disposed within the belt 24 for attachment of the arms. Thus, structures, such as the collars 26, may be connected to the belt 24 (FIG. 8) or apertures may be formed integrally in the belt 24 (FIG. 7) to receive the arms, or may be formed in the housing 12. The belt design merely makes the second lens system usable with luminaires previously described due to the tow piece housing design. Further, one skilled in the art will realize that the axial dimension of the belt 24 will dictate the aperture size located therein and therefore the amount of weight which can be supported by arms attached thereto. Such design is shown in FIG. 7 where the collars 26 are removed and the arms are fastened directly to the belt 24.

The outer lens 84 includes a sleeve 85 positioned through an aperture therein. An arm 86 is threadably fastened to the belt 24 or the collar 26 depending on the embodiment viewed. The arm 86 is cylindrical with a threaded fastening portion 87 which connects to the belt 24 or collar 26. The embodiments depicted utilize three equidistantly spaced arms 86 to support the second lens 84 in a spaced fashion from the housing 12 and first lens 42. The arms 86 are shown as substantially cylindrical in shape but one skilled in the art will recognize that alternative structural shapes may be utilized with this device. The arms 86 are positioned through the sleeves 85, which provide cushion and prevent breakage of the outer lens 84 from contact with the arms 86. Thus, the arms 86 may complement aperture shapes in the lens 84 and sleeves 85.

Figure 9:
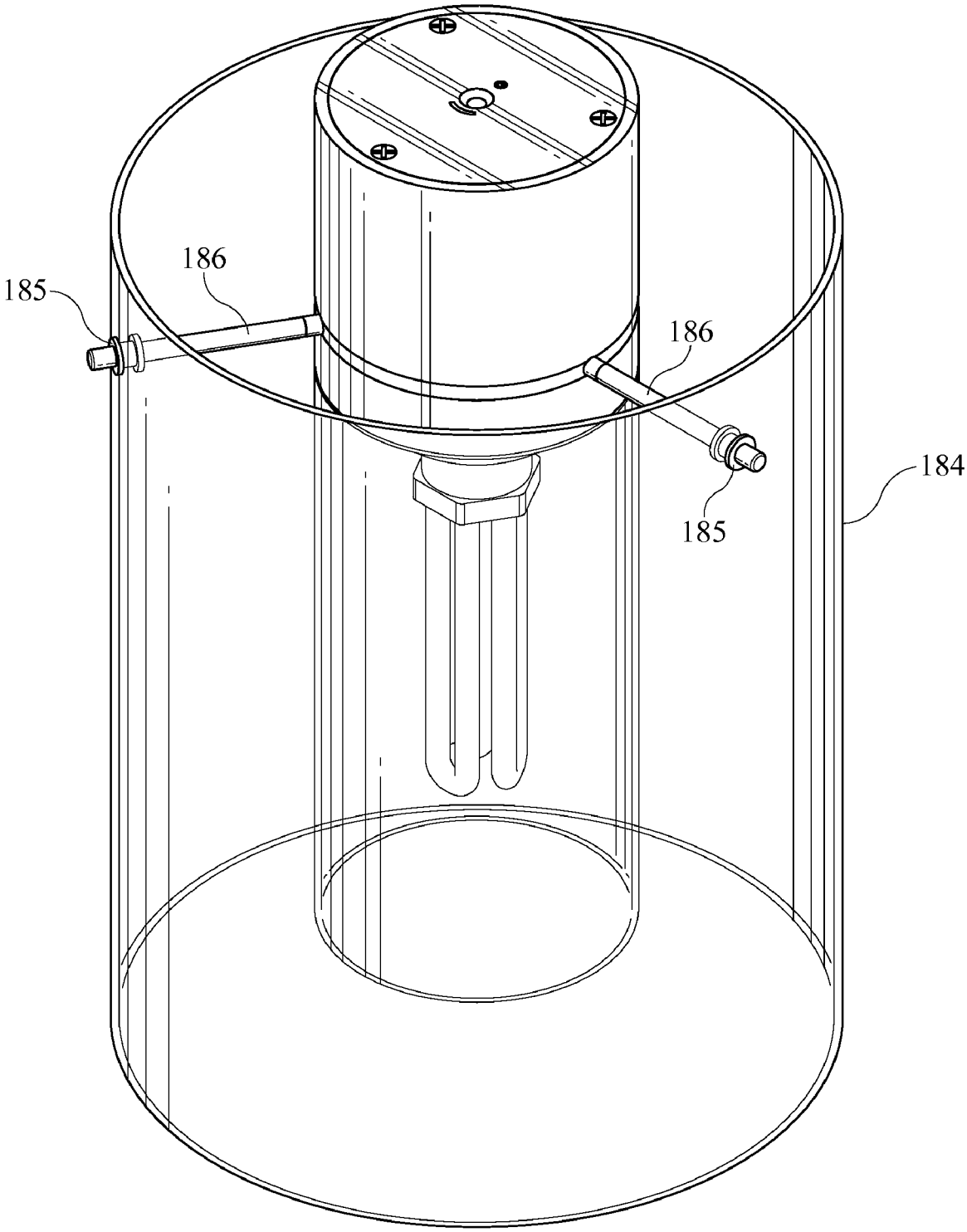
FIG. 9 depicts a perspective view of an alternative embodiment of FIG. 7.

Referring to FIG. 9, an alternative embodiment is shown with longer arms 186 and an outer lens 184, having a substantially larger diameter than the lens 84 shown in FIGS. 7-8. The arms 186 have a length greater than that of arms 86 previously described and may also have a larger diameter to support the additional weight of the larger lens 184. Accordingly, sleeves 185 must be sized to accommodate the larger arm 186 diameter.

Figure 10:
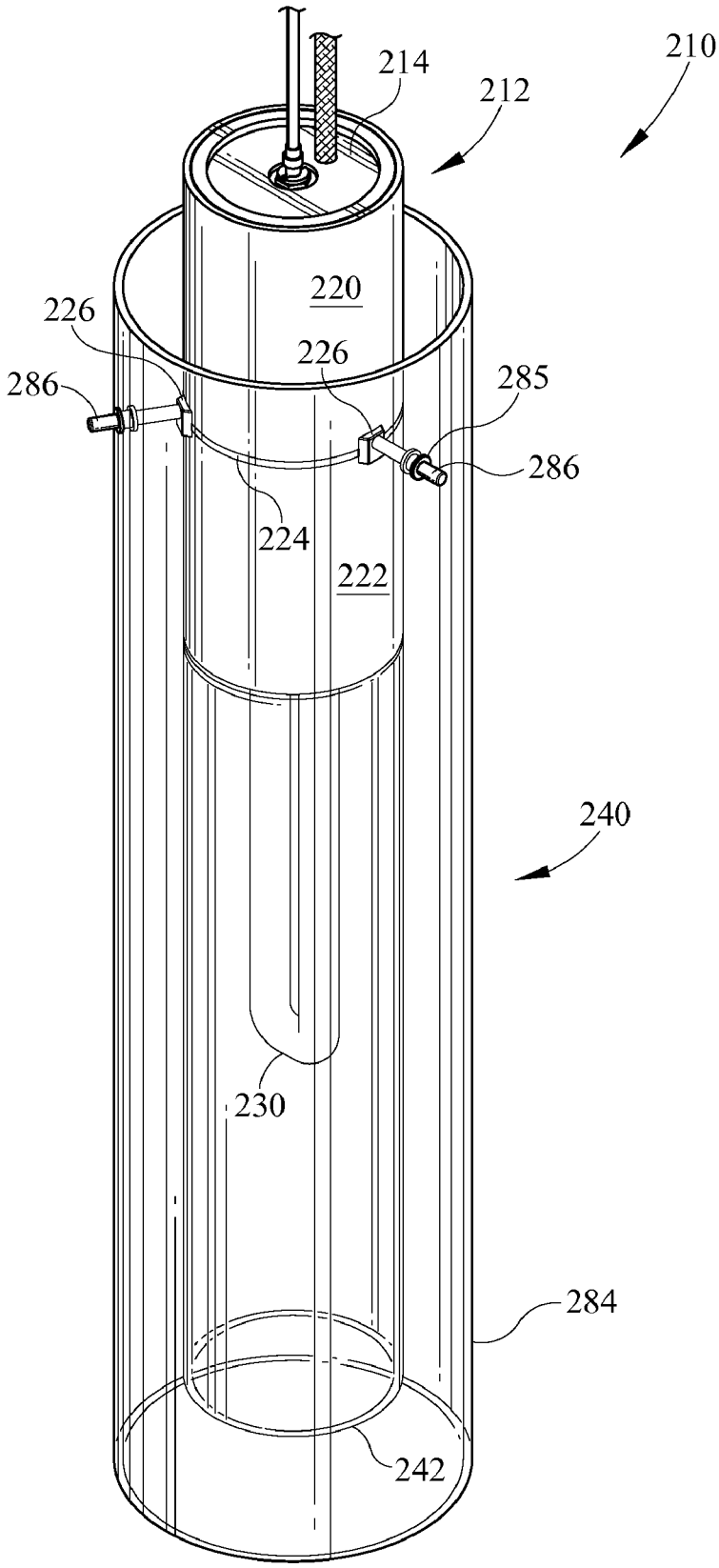
FIGS. 10-13 depict perspective views of various alternative embodiments related to FIG. 7; and, FIG. 14 depicts a perspective view of a sconce luminaire utilizing an optical assembly of FIG. 4 or 5.

Referring now to FIG. 10, an alternative embodiment of the luminaire 210 is depicted. The luminaire 210 comprises a housing 212 and an optical assembly 240. The housing 212 comprises an upper portion 220 and a lower portion 222 which sandwich a belt 224. The lower portion 222 has a longer axial dimension than the previously described lower portions but such construction should not be considered limiting. The housing 212 of the present exemplary embodiment is shown to be long and slender as opposed to a large diameter luminaire. Such luminaire 210 may be more appropriate for use in smaller rooms or spaces where a larger luminaire would not appear to be aesthetically pleasing. The housing 212 further comprises a top cover 214 through which a pendant cable and conduit extend to provide power supply to electrical components disposed within the housing 212. The slender design of the luminaire 210 and housing 212 further requires that the band 224 have a small axial diameter which matches the aesthetic features of the housing 212 and renders the luminaire 210 aesthetically pleasing. In order to connect the arms 286 to the small axial dimension band 224, clips 226 are positioned on the band 224 providing a larger dimension to which the arms 286 may be fastened. The clips 226 are frusto-pyramidel in shape although alternative shapes may be utilized which can support the arms 286 and lens 284. Due to the smaller diameter of the outer lens 284 as compared to the embodiment of FIG. 9, the arms 286 are relatively short.

A lamp 230 is connected to a socket positioned in or against the lower portion 222 of the housing 212. The lamp 230 may alternatively be any of the previously recited alternative light sources.

Figure 11:
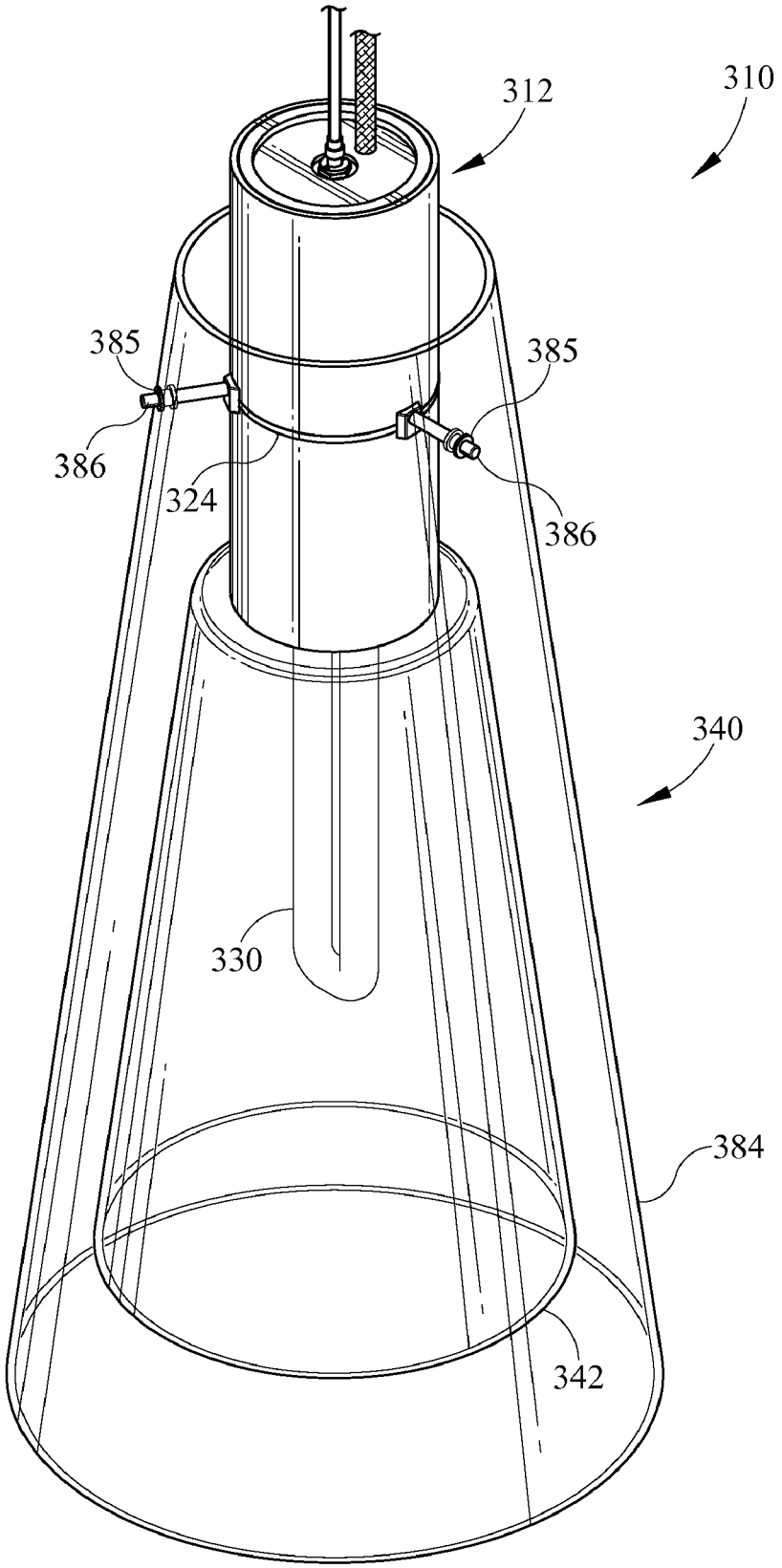

Referring now to FIG. 11, a further alternative luminaire 310 is depicted. The embodiment depicts alternative lens shapes which may be utilized. The housing 312 is connected to an optical assembly 340 in the manner previously described in FIG. 10 as the housing 312 diameter is small as previously described. However, the optical assembly comprises an inner lens 342 which is frusto-conical in shape. An outer lens 384 is also frusto-conical in shape and extends upwardly substantially parallel to the inner lens 342 where it is engaged by arms 386. The arms 386 are supported from clips as described in the embodiment of FIG. 10. The outer lens 384 comprises at least one sleeve 385 positioned in an aperture through which the arms 386 pass. According to the exemplary embodiment, three apertures are shown which receive three arms 386 respectively, although various numbers of arms may be utilized. However, one skilled in the art should realize that the housing 312 may be increased in diameter and that the band 324 may be changed as well.

Figure 12:
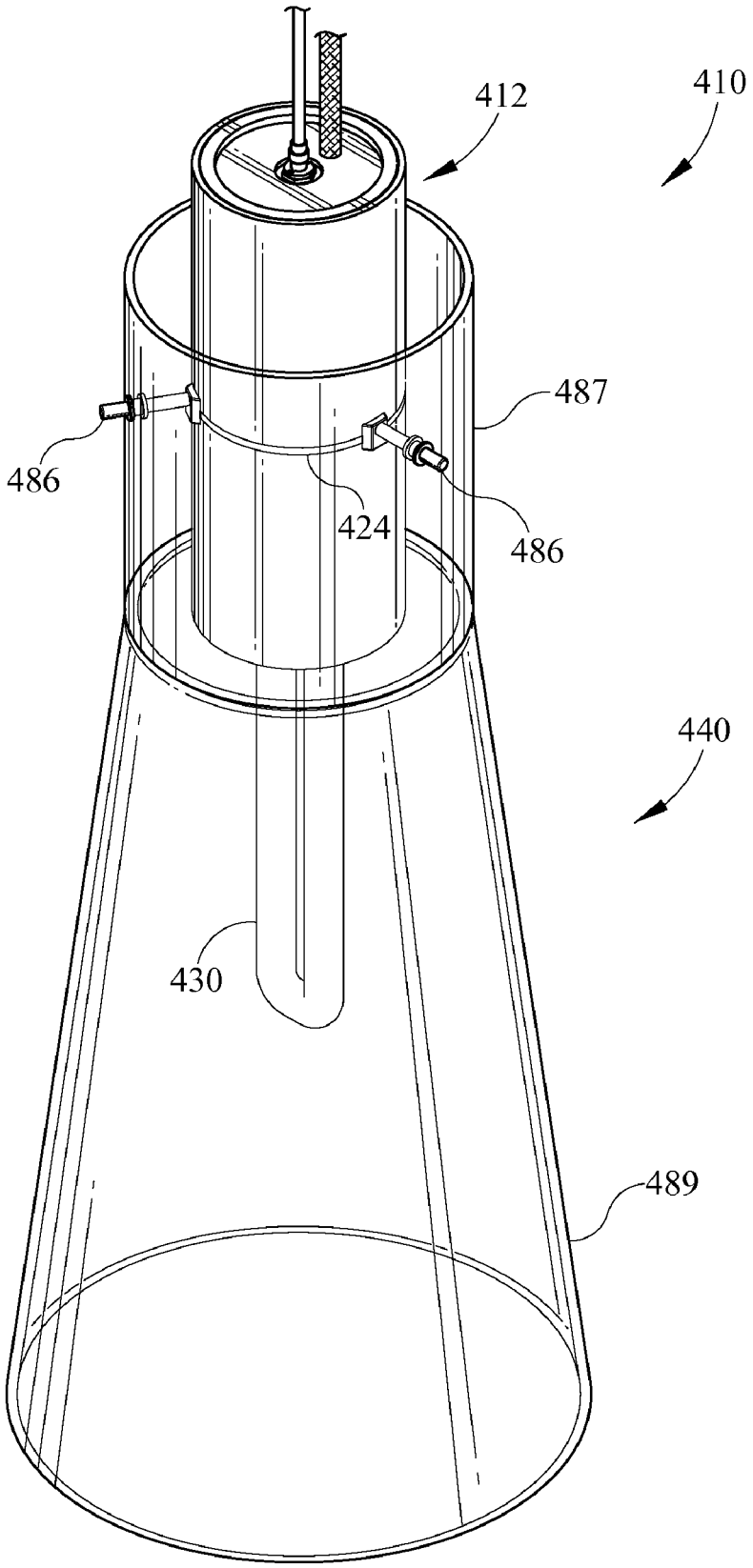

Referring now to FIG. 12, a further embodiment of a luminaire 410 is depicted. The device comprises a housing 412 having a belt 424 with arms 486 extending therefrom. A lamp 430 extends from a lower portion of the housing 412. The lamp 430 is smaller than some previous embodiments however, alternative lamp types and sizes may be utilized. The luminaire 410 further comprises an optical assembly 440 comprising an upper lens portion 487 which is supported by the arms 486 and a lower portion 489 which is substantially frusto-conical in shape and connected to the lower peripheral edge of the upper portion 487. Alternatively, the upper portion 487 and lower portion 489 may be integrally formed so that a substantially seamless optical assembly 440 is defined. One skilled in the art will realize that the housing 412 may be increased or decreased in diameter and that the band 424 may be changed as well as the lenses 487, 489.

Figure 13:
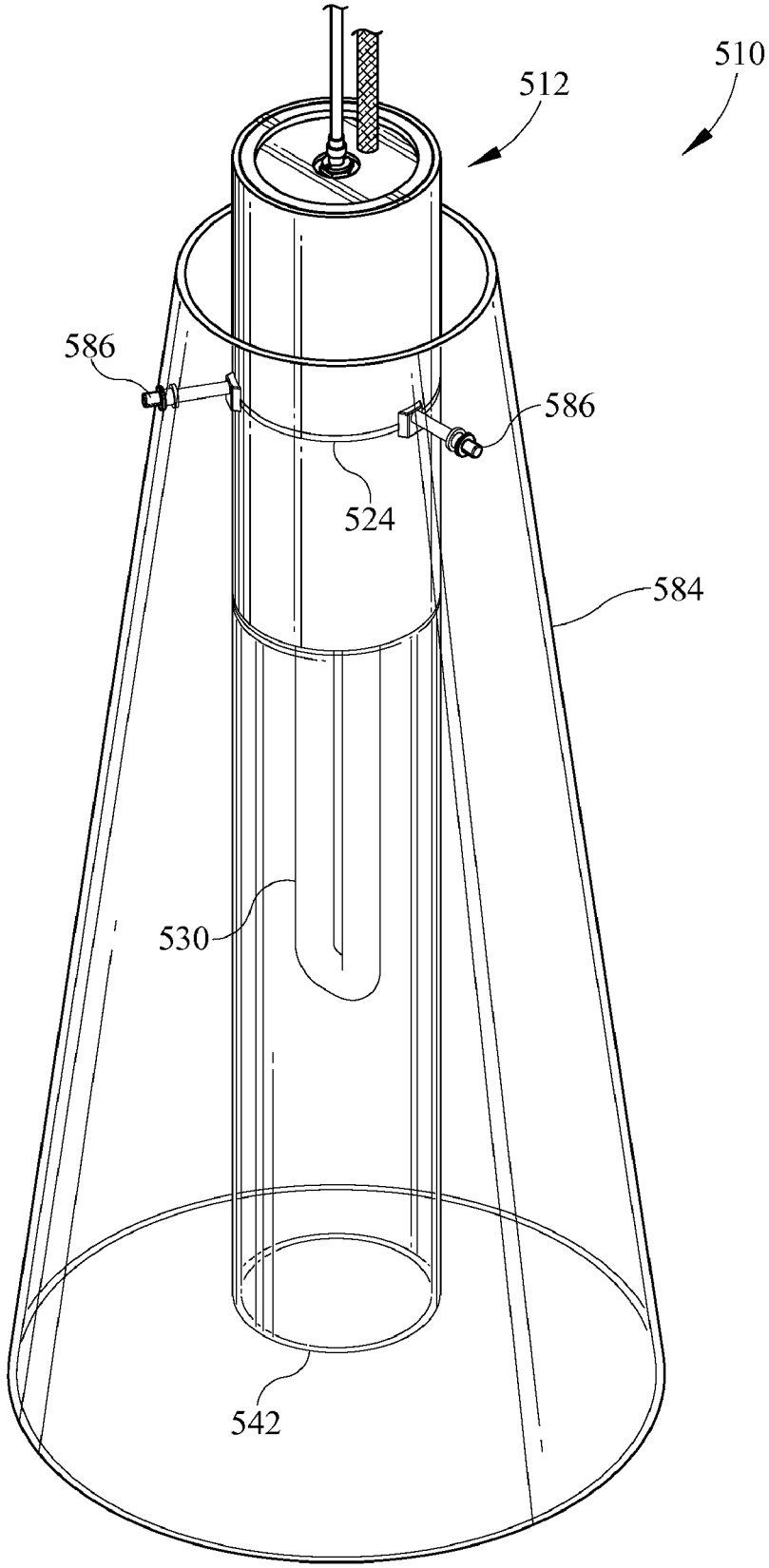

Referring now to FIG. 13, an alternative luminaire 510 is depicted having a housing 512, which includes a belt 524 from which arms 586 are extending, in a manner previously described. The device further comprises a first lens 542 fastened to the housing 512 using the collar assembly previously described. Disposed over the housing 512 and inner lens 542 is a second outer lens 584 which is substantially frusto-conical in shape and supported from the arms 586 as depicted. The various embodiments of FIG. 9-14 depict the various lens shapes and connections which may be utilized to connect the outer lens to the housing.

Referring now to FIG. 14, an alternative embodiment of a luminaire 610 is depicted. The luminaire 610 comprises a housing 612 to which a lens 642 is fastened. The housing 612 is fastened to or integral with a base 613. In this embodiment, the luminaire 610 is a sconce such that the base 613 may be fastened to a wall to provide light from the lamp 630 in a downward direction, or an upward direction if the base 613 is rotated 180 degrees.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A luminaire lens mounting assembly, comprising:

a first lens connected to a housing;

a light source extending from said housing;

a belt connected to said housing;

at least one arm extending from a position above said first lens and from said belt; and, a second lens surrounding at least one of said housing and said first lens, said second lens having an uppermost position disposed above said first lens in order to receive said at least one arm;

said at least one arm extending through said second lens.

2. The luminaire assembly of claim 1, said housing having a first portion and a second portion.

3. The luminaire assembly of claim 2, said belt disposed between said first portion and said second portion.

4. The luminaire assembly of claim 2, said first portion connected to said second portion by threaded fasteners.

5. A luminaire lens mounting assembly, comprising:

a first lens depending from a housing;

a lamp connected to a socket of said housing;

a plurality of arms extending from said housing;

said arms extending through a second lens, wherein said first lens is radially spaced from said second lens and at least a portion of said second lens extends above an uppermost level of said first lens.

6. The luminaire lens mounting assembly of claim 5 further comprising a belt connected to said housing.

7. The luminaire lens mounting assembly of claim 6, said plurality of arms extending from said belt.

8. The luminaire lens mounting assembly of claim 6 further comprising at least one clip connected to said belt.

9. The luminaire lens mounting assembly of claim 8, each of said plurality of arms connected to one of said at least one said clip.

10. The luminaire lens mounting assembly of claim 6, said second lens surrounding said first lens.

11. The luminaire lens mounting assembly of claim 6, said second lens surrounding at least a part of said housing.

12. The luminaire lens mounting assembly of claim 6, said arms equidistantly spaced.

13. The luminaire lens mounting assembly of claim 6 further comprising a sleeve disposed between said second lens and said arms.

14. A luminaire lens mounting assembly, comprising:

a housing;

a plurality of arms supported by said housing;

a light source connected to said housing;

a first lens fastened to said housing;

a second lens extending about said housing and said first lens;

said plurality of arms extending through said second lens and supporting said second lens at a position above an uppermost position of said first lens.

15. The luminaire lens mounting assembly of claim 14 further comprising a belt.

16. The luminaire lens mounting assembly of claim 15, said belt having a plurality of clips for receiving said arms.

17. The luminaire lens mounting assembly of claim 15, said belt having apertures for receiving said arms.

18. The luminaire lens mounting assembly of claim 15, said belt captured between an upper and a lower portion of said housing.

* * * * *